United States Patent [19]

Holloway

[11] Patent Number: 4,982,593

[45] Date of Patent: Jan. 8, 1991

[54] GRIPPER MEANS FOR STRETCHER LEVELER APPARATUS

[75] Inventor: Bertram A. Holloway, Washington, Pa.

[73] Assignee: Washington Steel Corporation, Washington, Pa.

[21] Appl. No.: 376,387

[22] Filed: Jul. 6, 1989

Related U.S. Application Data

[63] Continuation-in-part of Ser. No. 819,028, Jan. 15, 1986, abandoned, which is a continuation-in-part of Ser. No. 485,275, Apr. 15, 1983, abandoned.

[51] Int. Cl.[5] ..... B21D 25/04

[52] U.S. Cl. ..... 72/302; 269/274; 269/286

[58] Field of Search ..... 72/302; 269/286, 274, 269/275; 81/418, 421–423, 424.5, 900, 186; 427/409; 264/265, 274, 259, 135

[56] References Cited

U.S. PATENT DOCUMENTS

| | | | |
|---|---|---|---|
| 2,519,107 | 8/1950 | Brown | 269/275 |
| 2,594,684 | 4/1952 | Rothe | 269/286 |
| 2,766,649 | 10/1956 | Labry | 269/274 |
| 2,980,046 | 4/1961 | McGregor | 72/350 |
| 3,047,934 | 8/1962 | Magner | 264/265 |
| 3,290,199 | 12/1966 | Willhoite | 264/135 |
| 3,322,423 | 5/1967 | Popow | 269/274 |
| 3,515,139 | 6/1970 | Mallina | 81/421 |
| 4,114,245 | 9/1978 | Bainard | 264/135 |

FOREIGN PATENT DOCUMENTS

| | | | |
|---|---|---|---|
| 16193 | 9/1966 | Japan | 264/135 |
| 168501 | 7/1934 | Switzerland | 72/302 |

*Primary Examiner*—Daniel C. Crane

*Attorney, Agent, or Firm*—Cohen & Grigsby

[57] ABSTRACT

A gripper means for use in a stretcher leveler apparatus in which the surface for engagement with the metal to be stretched comprises a smooth polymeric material most desirably of a thermoset polyurethane.

7 Claims, 1 Drawing Sheet

GRIPPER MEANS FOR STRETCHER LEVELER APPARATUS

RELATED PATENTS

This a continuation-in-part of co-pending U.S. patent application 06/819,028 filed Jan. 15, 1986, now abandoned, which in turn a continuation-in-part of abandoned U.S. patent application 06/485,275 filed Apr. 15, 1983, now abandoned.

FIELD OF THE INVENTION

The present invention relates to an improved gripper means for use with a stretcher leveler device, in particular, to improved grippers which eliminate disfigurement of the surface of steel sheets undergoing stretcher leveling.

BACKGROUND OF THE INVENTION

The two primary methods of providing straight or flattened steel strip or sheet are roller leveling and stretcher leveling. Roller leveling is typically performed in a rolling machine consisting of two sets of rolls. A top and bottom set of several small diameter horizontal rows each are mounted in a housing so that the associated top and bottom rolls are offset from each other. A steel sheet or strip passing through the leveler is flexed up and down alternately between the offset rolls such that the amount of flexing decreases as the sheet travels toward the exit end of the roller leveler. The rolls nearest the exit end are designed to perform the basic straightening operation. The advantage of roller leveling is that long lengths of sheet or strip may be leveled or flattened with minimum surface disfigurement. However, roller leveling does not impart the same degree of flatness to the sheet or a pair of opposing jaws actuated by hydraulic or pneumatic means. Typically, sheet or strip is elongated between one and three per cent so that the elastic limit of the steel is exceeded to produce permanent elongation. There are numerous types of stretcher leveler devices including those which can handle large coils of rolled strip. However, in all stretcher levelers the jaws of the device include gripping means to securely grip the opposing ends of the sheet which is to be stretched. These gripper means typically comprise a flat elongated engagement member shaving a length slightly greater than the width of the sheet or strip to be stretched. The surface of the engagement member which is adapted to engage or grip the surface of the sheet or strip to hold it against movement during elongation is very rough, normally grooved, knurled or serrated. Consequently, in virtually all such stretcher leveler devices the gripper means bite into the metal and disfigure the surface of the sheet. Traditionally, the disfigured portion of the sheet or strip is marked and subsequently cut off as scrap. For example, in a coil 2,125 feet in length, approximately 162" are lost in scrap.

The disfigurement of the metal results in substantial economic loss because that metal is normally discarded as waste. Moreover, when coils of rolled strips are stretched in sequential stretching, the gripper disfigurement marks must be indicated and cut from the coil. Thus, the maximum length of strip or sheet which could be leveled is the distance between the grippers.

It is, therefore, an object of the present invention to provide a gripper means for use on stretcher leveler devices which affords adequate gripping capabilities, but which eliminates surface disfigurement on the sheet or strip stretched. A further object of the present invention is to provide gripper means which will enable stretching cf any length of strip by successive stretching operations such that an entire coil of rolled strip, in effect, can be stretcher leveled without the need to remove the portions of metal engaged by the gripper.

SUMMARY OF THE INVENTION

The present invention comprises a novel gripper means which overcomes the disadvantages of the prior art grippers by having a very smooth engagement surface formed from a high density polymeric material. The engagement surface is preferably made from a cast high density thermoset polyurethane. The preferred urethane is Adiprene® (manufactured by Mobay Chemical Co.) which has a durometer of between 60 and 95 on the "D" scale and 75–95 on the "A" scale. The polymeric surface may be integrally bonded to a metal backing gripper plate machined to adapt directly to the stretcher leveler device.

While polyurethane is the preferred material, other polymeric urethanes or materials having the same physical characteristics may be used. For example, it has been found that high density polyethylene does not provide satisfactory results. Accordingly, to achieve the significant benefits of the present invention, the preferred polyurethane should be used. With respect to secondary evidence of patentability, Dr. Watson and Dr. Hershberger both at the time employed by the NASA Industrial Applications Center, University of Pittsburgh, and who assisted in the design of the adhesive for and the material of the tiles on the Space Shuttle, attempted in the latter part of 1982 to solve the problem of marring of metal by the stretcher leveler. They determined from their analysis of the facts that polyethylene was the material of choice for the gripping surface. However, the polyethylene completely failed. The metal to be gripped slipped through the gripping surface and stretching could not be accomplished.

Other advantages of the present invention will become apparent from a perusal of the following detailed description of the presently preferred embodiment taken in connection with the accompanying drawings.

PRESENTLY PREFERRED EMBODIMENT

Figure 1:
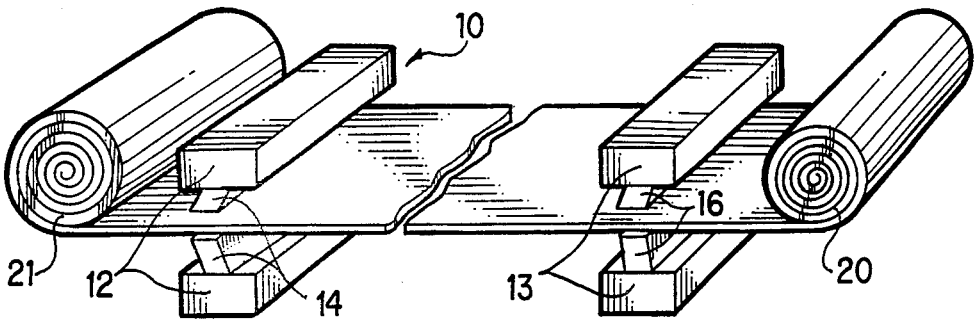
FIG. 1 is a diagrammatic illustration of a conventional stretcher leveler used to flatten coils of rolled steel strip.

With respect to FIG. 1, an illustrative function diagrammatic view of stretcher leveler 10 is shown having a pair of opposing jaws 12 and 13, each pair of jaws including a pair of gripper means 14 and 16, respectively. Jaws 12 and 13 may be actuated (opened or closed) in the vertical direction by means of hydraulic or pneumatic pistons or other actuating means, not shown. As shown in FIG. 1, a coil strip 20 of metal, such as steel or titanium, is positioned to run through stretcher means 10 for successive stretcher operations between the jaws 12 and 13 where it is taken upon take-up coil 21. Where the distance between jaws 12 and 13 is great, for example, 80 feet or more, the strip is supported by a plurality of rolls, not shown, or other support means.

In typical operation, strip 20 is positioned between jaws 12 and 13 which are hydraulically or pneumatically controlled to engage by means of gripper pairs 14 and 16 and surface of strip 20. Once a firm contact is made with the strip, hydraulic means (not shown) actuates a pair of jaws to move in opposite direction from the other pair to elongate the strip 20 between jaw pairs 12 and 13. Once elongation has been achieved, jaws pairs 12 and 13 are opened and the stretched portion of strip is incrementally taken up on take-up coil 21 and the next stretching operation commenced. By successive stretching operations, entire coil 20 can be stretcher leveled.

In the prior art, gripper means 14 and 16 precluded a continuously stretcher leveled coil without substantial surface disfigurement. In addition, it is a common requirement that each surface blemish be marked so that the end user of coil 21 can readily determine the location of each blemish. Such requirement necessitates either the use of automatic marking machines or manual markers; both of which add to the cost of stretcher levelling. However, in accordance with the present invention entire take-up coil 21 is stretcher leveled and unblemished either by surface disfigurement or indicator marks.

Figure 2:
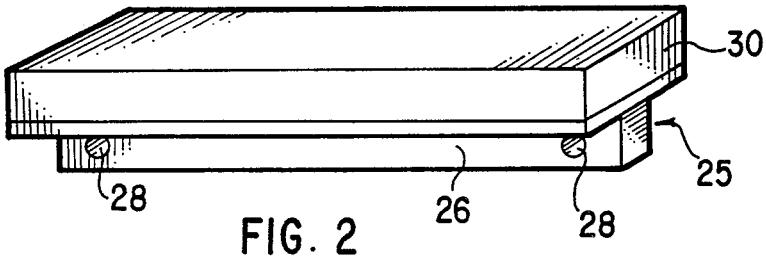
FIG. 2 is a perspective view of a gripper means having an engagement surface in accordance with the present invention.
Figure 3:
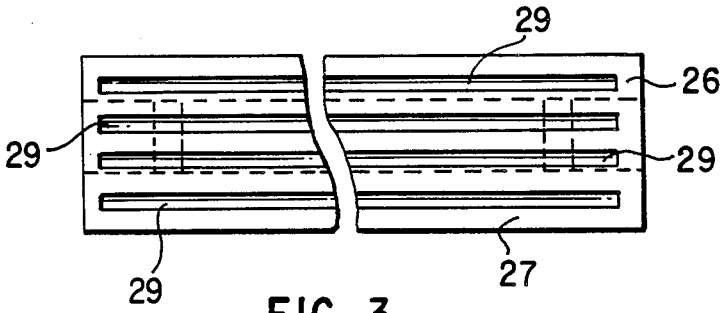
FIG. 3 is a plan view of a gripper plate surface.
Figure 4:
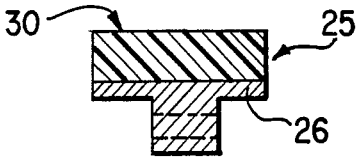
FIG. 4 is a sectional elevation of gripper means in accordance with the present invention.

Referring to FIGS. 2–4, the gripper means 25 of the present invention comprises a gripper support pad or member 26 adapted to mount on stretcher leveler 10 for use in gripper pairs 14 and 16. Preferably, support member 26 is made of 4140 high tempered carbon. Gripper support member 26 includes support surface 27 to which polymeric_gripping surface 30 is secured. The surface 27 can have grooves 29 which are preferably disposed in the surface such that they are perpendicular to the direction metal is stretched by the stretcher leveler. The grooves 29 present a greater surface area of the support surface 27 to which the gripping surface 30 can anchor or bond during casting. In a practical embodiment, support pad or member 26 is about 51" long and 5" wide. The grooves are preferably 1/16 of an inch in depth, 1/16 of an inch wide, and approximately 49 inches long. Support pad or member 26 also includes openings 28 for mounting and operatively anchoring the member 26 on a stretcher leveler.

Each gripper pair 14 and 16 requires two gripper means 25, one on top and one on the bottom. The gripping surface covers the support surface and is between 1/16 of an inch and 2 inches thick and preferably ⅛ of an inch thick. If the gripping surface 30 is too thick, the gripping surface 30 breaks down faster over time during operation of the stretcher leveler. If it is too thin, then the metal is not protected from the steel support member 26 and is marred. Optimally, the thickness of the gripping surface 30 is such that no marring to the metal occurs and a minimal amount of bending is experienced by the gripping surface so it lasts longer.

Preferably, gripping surface 30 is a cast thermoset polyurethane such as Adiprene® (mfd. by Mobay Chemical Co.) which combines the qualities of both plastic and rubber. Gripping surface 30 is preferably cast, in situ, on support pad or member 26 at a temperature of about 200° F. Immediately prior to casting, however, it is desirable to thoroughly clean surface 27, such as by sand blasting, and to apply an adhesive such as a thixon based adhesive (e.g., 403/404 or 409 type adhesive) to increase the binding strength of the member 26 with the gripping surface 30. The edges of the gripper surface that are on the metal contact side thereof are preferably rounded.

Preferably, the physical properties of cast gripping surface 30 are:

| ASTM D412 | Tensile Modular-PSI |
|---|---|
| @ 50% elongation | 750 |
| @ 100% elongation | 2000 |
| @ 300% elongation | 4000 |
| @ break | 9000 |
| Compression modular at 25% elongation deflection, shape factor 1.0 | 8000 |
| % elongation at break (ASTM D412) = | 265 |
| Abrasive index (%) (ASTM P1630) = | 435 |

Essentially, the gripping surface 30 is preferably made of a material strong enough not to break down or tear away from the support surface under an applied force up to 250,000 pounds. The gripping surface must also have a coefficient of friction great enough to prevent slippage of it with respect to the metal-1 being stretched during operation of the stretcher leveler. Additionally, the gripping surface must not damage the metal that it grips. Preferably, the material has a diameter of 90.

Gripper means 25 in accordance with the present invention have been tested by applicant on its PM 84 stretcher leveler having a width up to 52" for running 48" stainless steel coils. The stretcher leveler can be adjusted to stretch sheet a minimum of only 180" in length of material between the jaws or up to 80' in length. The jaws are pneumaticly actuated and the actual force used to elongate the strip is applied by hydraulic pistons applying up to 250,000 pounds of force. Generally, elongation of 00.4% to 1.6% is achieved.

Gripper means 25 in accordance with the invention generally last 2,000 or more stretcher levelings. Moreover, it has been found that it is desirable that the width of gripping surface 30 be from 2" to 8," and preferably about 5" in width. However, a width as small as ¾" has been successfully used in a larger stretcher leveler.

Because there is no marring of the surface of the stretcher leveled strip, no material has to be cut out resulting in a saving of up to 5% of the metal.

A particularly suitable polymeric material for forming the cast gripper surface (and also its integral support pad or member 26) as described in relation to FIG. 4, is adiprene 410 liquid resin. In the embodiment of FIG. 1 above, the liquid polymeric is to be poured upon the prepared carbon steel support surface 27 and then is cured in situ to form the cast rigid gripping surface 30. It is preferable, however, to precoat the steel surface 27 with thixon (R) adhesive as a base, before the pour application of the preferred polyurethane resin. This will ensure the cast gripping surface's adhesion to the support pad or member 26, despite the massive shearing pressure that the gripper jaws will undergo while up to 250 tons of tensile stress are repetitively placed upon the extended coil length to achieve the conventional stretcher leveler process, required in selective steel sheet applications.

The casting, in situ, on the support member 26 preferably occurs in a vacuum or as close to a vacuum as possible. The method of casting is preferably accomplished by first evacuating a chamber having the support member 26. Then the polymeric material is heated until it liquifies (200° F. for polyurethane) and poured on the support surface 27 of the support member 26. The liquid polymeric material is allowed to solidify and form the gripping surface 30. During this entire operation, the chamber is evacuated to minimize the potential for bubbles forming in the gripping surface 30. Any bubbles in the gripping surface 30 could weaken the gripping surface or allow the jaws to marr the metal along a deformity in the gripping surface where a bubble has caused an opening in the surface.

The economy effected by the present invention can be delineated by describing the experience with an average gauge (chief thickness) coil being first finished and then cut-up in a plant setting to produce 10 foot long cut sheets for shipping. The coil precursor is 0.048 inches gauge, 48 inches in width, and would weigh an average of 8 pounds per linear foot of coil length. By preclusion of the occurring of the prior art permanent gripping indentations, about $1.00 per pound of steel to save from scrappage. This equates to $4.00 per elongation for an 80 foot section of coil. Since the average coil has 2,125 linear feet, this would approximate 27 stretches, for the average length coil, or a savings in reduced scrappage of about $108.00 per coil being elongated, using the gripping means of the present invention. This is the corollary of the increased usable length of 162 inches per coil (circa 15 feet). Also being obviated is the prior scrappage of the uneven length short sheets (those falling under the preset 10 foot sheet), which heretofore have occurred at the beginning and end of each processable coil.

The final gain is in an opening to demand for coil sections exceeding 80 feet in length (the maximum span for the elongation jaws) since the visible surface imperfections are being avoided. So, the maximum length of an unblemished section is now only determined by the length of the coil itself, and, as noted, these routinely exceed 2,000 feet before being subjected to the elongation step which can add another 1% to the length of the shipped product.

While presently preferred embodiments of the invention have been shown and described in particularity, it may be otherwise embodied within the scope of the appended claims.

What is claimed is:

1. A stretcher leveler apparatus capable of applying up to 250,000 pounds of force comprising a first gripping jaw adapted to be closeable with an identically aligned second gripping jaw, whereby both jaws of a first pair can hold firmly one section of an uncoiled metal strip passing therebetween during the periods of high stress elongation of the strip length lying between the first pair defining one end of the metal strip and a second pair of opposing gripping jaws operating simultaneously at a distance from the first pair of jaws and forming the second end of the elongating strip section to be elongated, the improvement comprising each jaw having a gripper means consisting essentially of a. a high density, cast polyurethane gripping surface adapted for engagement with the metal section to be stretched and operatively anchored to the contact jaw faces, said gripping surface being positioned in a plane parallel to the surface of the metal to be engaged, and b. said gripping surface includes an integral reinforcing means made of steel adapted to maintain the transverse rigidity of the said surface during coil engagement and the forces incident to elongation of a strip length when up to 250,000 pounds of force are applied to the metal through the jaws, said gripping surface being operatively anchored to each jaw through the reinforcing means, said gripping surface being cast in situ on the reinforcing means.

2. The improved gripper means of claim 1, in which the cast polyurethane material on its non-gripping surface is also adhesively bonded to the outwardly disposed face of the rigid reinforcement means which has substantially the same dimensions as the gripping surface.

3. An apparatus as described in claim 1 wherein said reinforcing means has a support surface, and support surface having grooves such that a greater surface area of the support surface is presented to the gripping surface to which it can anchor when it is cast.

4. A metal stretcher leveler gripper means comprising a substantially "T" shaped support member having a support surface made of steel and a cast polyurethane gripping surface mounted coextensively to said support surface, said gripping surface being positioned in a place parallel to the surface of the metal to be engaged, said gripping surface being cast in situ on the support surface of the support member, said gripping means capable of withstanding up to 250,000 pounds of force, said metal support having means for mounting said gripper means within a stretcher leveler apparatus comprising opposed gripper means spaced from one another and movable in opposite directions to stretch metal.

5. An apparatus as described in claim 4 wherein the support surface has grooves such that a greater surface area of the support surface is presented to the gripping surface to which it can anchor when it is cast.

6. In a method for stretcher leveling metal between spaced ends of a length of said metal, said stretcher leveling capable of providing up to 250,000 pounds of force, the improvement comprising gripping the metal at one end of the metal to be stretched with a smooth polymeric surfaced gripping means comprising a thermoset polyurethane cast in situ on a support member made of steel and moving said one end gripped by said gripping means relative to the other end of the metal so as to stretch the metal between the ends of the length of metal.

7. In a method for stretcher leveling a metal, the improvement comprising gripping the surfaces of the metal to be stretched at opposite ends by contacting such metal surfaces with smooth polyurethane surfaces cast in situ on a support member made of steel, said polyurethane surfaces extending substantially the width of the metal and applying pressure to said polymeric surfaces thereby effecting the gripping of the metal and thereafter stretching the metal therebetween in a direction perpendicular to the pressure applied to said polyurethane surfaces by moving the gripped ends of the metal in opposite directions.

* * * * *

UNITED STATES PATENT AND TRADEMARK OFFICE

CERTIFICATE OF CORRECTION

PATENT NO. : 4,982,593

DATED : January 8, 1991

INVENTOR(S) : Bertram A. Holloway

It is certified that error appears in the above—identified patent and that said Letters Patent is hereby corrected as shown below:

Title Page, Column 1 - Bracket [73] - No Assignee

Delete: "Assignee: Washington Steel Corporation, Washington, Pa."

Signed and Sealed this

Seventh Day of July, 1992

*Attest:*

*Attesting Officer*

DOUGLAS B. COMER

*Acting Commissioner of Patents and Trademarks*